US011209754B2

(12) United States Patent
Lee et al.

(10) Patent No.: US 11,209,754 B2
(45) Date of Patent: Dec. 28, 2021

(54) STRUCTURE FOR SELECTIVELY LOCKING TONER INLET SHUTTER OF TONER REFILL PORTION

(71) Applicant: HEWLETT-PACKARD DEVELOPMENT COMPANY, L.P., Spring, TX (US)

(72) Inventors: SeungSup Lee, Suwon-si (KR); Min-Chul Lee, Pangyo (KR); Jiwon Moon, Pangyo (KR); Woongyong Choi, Yongin-si (KR)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 17/050,337

(22) PCT Filed: Mar. 5, 2019

(86) PCT No.: PCT/US2019/020769

§ 371 (c)(1),
(2) Date: Oct. 23, 2020

(87) PCT Pub. No.: WO2020/046421

PCT Pub. Date: Mar. 5, 2020

(65) Prior Publication Data

US 2021/0088939 A1 Mar. 25, 2021

(30) Foreign Application Priority Data

Aug. 30, 2018 (KR) ..... 10-2018-0102539

(51) Int. Cl.
*G03G 15/08* (2006.01)

(52) U.S. Cl.
CPC ..... *G03G 15/0894* (2013.01); *G03G 15/0867* (2013.01); *G03G 15/0886* (2013.01)

(58) Field of Classification Search
CPC ..... G03G 15/0894; G03G 15/0867; G03G 15/0886; G03G 15/556; G03G 2221/1654;
(Continued)

(56) References Cited

U.S. PATENT DOCUMENTS 3,599,682 A * 8/1971 Altmann ..... G03G 15/0884 141/106
3,651,838 A * 3/1972 Albert ..... G03G 15/0855 141/284
(Continued)

FOREIGN PATENT DOCUMENTS

EP 1548519 A2 * 6/2005 ..... G03G 15/0867
EP 2102715 9/2009
(Continued)

*Primary Examiner* — David J Bolduc
(74) *Attorney, Agent, or Firm* — Staas & Halsey LLP

(57) ABSTRACT

A printer includes a main body including a communicating portion, a development cartridge attachable to and detachable from the main body, the development cartridge to supply toner contained in a toner container to an electrostatic latent image formed on a photoconductor, to form a visible toner image, and a toner refilling portion connected to the toner container. The toner refilling portion includes a mounting portion into which a toner cartridge insertable from outside the main body through the communicating portion to be mountable, a toner inlet portion provided in the mounting portion to receive toner from the toner cartridge when the toner cartridge is mounted to the mounting portion, and an inlet shutter switchable between a blocking position where the toner inlet portion is blocked from receiving toner, and an inlet position where the toner inlet portion is open to receive toner. The printer includes a first latch member switchable between a first position where the inlet shutter is locked from switching between the blocking position and the inlet position and a second position where switching of
(Continued)

the inlet shutter is allowed to switch between the blocking position and the inlet position, and a switching unit to switch between the first latch member between the first position and the second position.

15 Claims, 17 Drawing Sheets

(58) Field of Classification Search
CPC ..... G03G 21/1676; G03G 15/0874; G03G 15/0877; G03G 21/1814; G03G 15/0865
See application file for complete search history.

(56) References Cited

U.S. PATENT DOCUMENTS 4,237,943 A * 12/1980 Ermel ..... G03G 15/0875 141/284
4,307,763 A * 12/1981 Wang ..... G03G 15/104 138/89
4,456,154 A * 6/1984 Herriman ..... G03G 15/0875 141/363
4,489,765 A * 12/1984 Yamada ..... G03G 15/0855 141/1
4,963,939 A * 10/1990 Kurando ..... G03G 15/0863 335/203
5,075,724 A * 12/1991 Wada ..... G03G 15/0855 399/12
5,079,591 A * 1/1992 Tomita ..... G03G 15/0855 399/262
5,089,854 A * 2/1992 Kaieda ..... G03G 15/0855 141/346
5,091,750 A * 2/1992 Yoshida ..... G03G 15/0886 399/106
5,150,807 A * 9/1992 Seyfried ..... G03G 15/0882 141/364
5,614,996 A * 3/1997 Tanda ..... G03G 21/12 141/363
5,802,431 A * 9/1998 Nagashima ..... G03G 15/0874 399/262
5,848,338 A * 12/1998 Okada ..... G03G 15/087 399/262
5,887,232 A * 3/1999 Phillips ..... G03G 15/0855 399/262
5,995,782 A 11/1999 Isobe et al.
6,212,338 B1 * 4/2001 Hagihara ..... G03G 15/0863 399/12
6,249,654 B1 * 6/2001 Kurz ..... G03G 15/087 399/12
6,266,506 B1 * 7/2001 Kurz ..... G03G 15/087 399/12
6,304,739 B1 * 10/2001 Katsuyama ..... G03G 15/0874 222/DIG. 1
6,393,241 B1 * 5/2002 Matsumoto ..... G03G 15/0822 399/258
6,571,076 B2 * 5/2003 Kasahara ..... G03G 15/0874 399/258
6,598,625 B2 * 7/2003 Allison ..... B41J 2/17509 141/18
6,676,252 B2 * 1/2004 Bilotta ..... B41J 2/17509 347/85
6,813,460 B2 * 11/2004 Sudo ..... G03G 15/0874 399/258
6,862,420 B1 * 3/2005 Less ..... G03G 15/0884 399/258
7,300,130 B2 * 11/2007 Bellinger ..... B41J 2/17513 347/17
7,831,190 B2 11/2010 Yang
7,959,270 B2 * 6/2011 Durham ..... G03G 15/0855 347/85
8,385,772 B2 2/2013 Yoon et al.
8,929,776 B2 * 1/2015 Yamabe ..... G03G 15/0879 399/258
9,360,799 B2 * 6/2016 Itabashi ..... G03G 15/0879
11,055,038 B2 * 7/2021 Lavigne ..... B41J 2/17546
2001/0041083 A1 * 11/2001 Terazawa ..... G03G 15/0865 399/258
2002/0009310 A1 * 1/2002 Kabumoto ..... G03G 15/0126 399/258
2002/0039502 A1 * 4/2002 Matsumoto ..... G03G 15/0877 399/258
2003/0118355 A1 * 6/2003 Guy ..... G03G 15/0863 399/12
2003/0170049 A1 * 9/2003 Itoh ..... G03G 15/0865 399/258
2004/0037591 A1 * 2/2004 Schlageter ..... G03G 15/0855 399/258
2004/0040614 A1 * 3/2004 Sesek ..... B41J 2/17506 141/2
2005/0013633 A1 * 1/2005 Harumoto ..... G03G 15/0855 399/258
2005/0041998 A1 * 2/2005 Fujii ..... G03G 15/086 399/258
2005/0157117 A1 * 7/2005 Silverbrook ..... B41J 2/17506 347/86
2005/0220481 A1 10/2005 Yamaguchi et al.
2006/0002743 A1 * 1/2006 Katsuyama ..... G03G 15/0877 399/258
2006/0104673 A1 * 5/2006 Sasae ..... G03G 15/0886 399/262
2006/0109320 A1 * 5/2006 Cutler ..... B41J 2/17506 347/84
2006/0263116 A1 * 11/2006 Katsuyama ..... B65D 1/0292 399/258
2007/0003325 A1 1/2007 Jung et al.
2007/0116494 A1 * 5/2007 Uno ..... G03G 15/0865 399/258
2008/0025743 A1 * 1/2008 Hori ..... G03G 15/0877 399/61
2009/0277911 A1 * 11/2009 Koide ..... B65D 77/062 220/495.08
2009/0297226 A1 * 12/2009 Nagashima ..... G03G 15/0872 399/258
2010/0092216 A1 * 4/2010 Spence ..... G03G 15/0822 399/258
2011/0097094 A1 * 4/2011 Hamano ..... G03G 15/0856 399/27
2011/0217067 A1 * 9/2011 Tokuno ..... G03G 15/0872 399/110
2012/0177406 A1 * 7/2012 Suzuki ..... G03G 15/0874 399/120
2012/0269540 A1 * 10/2012 Kawai ..... G03G 21/181 399/109
2013/0243445 A1 * 9/2013 Takahira ..... G03G 21/1633 399/13
2014/0169838 A1 6/2014 Nagashima et al.
2014/0227008 A1 * 8/2014 Janssen ..... G03G 15/0886 399/258
2015/0063865 A1 * 3/2015 Furuichi ..... G03G 15/0865 399/111
2016/0109827 A1 * 4/2016 Yoshida ..... G03G 15/0886 399/260
2016/0313670 A1 * 10/2016 Eto ..... G03G 15/0875
2016/0357126 A1 * 12/2016 Kim ..... G03G 15/0886
2017/0153575 A1 * 6/2017 Schulkes ..... G03G 15/0881
2018/0059576 A1 3/2018 Nishiyama
2020/0133180 A1 * 4/2020 Mitsuhashi ..... G03G 15/0894
2020/0307870 A1 * 10/2020 Nakamura ..... B65D 47/046
2021/0103235 A1 * 4/2021 Oshima ..... G03G 15/0894
2021/0103242 A1 * 4/2021 Umeda ..... G03G 15/5016
2021/0103246 A1 * 4/2021 Morihara ..... G03G 15/0886
2021/0109460 A1 * 4/2021 Kubo ..... G03G 15/0894

FOREIGN PATENT DOCUMENTS

JP H0862979 3/1996
JP 10020647 A * 1/1998

* cited by examiner

STRUCTURE FOR SELECTIVELY LOCKING TONER INLET SHUTTER OF TONER REFILL PORTION

CROSS REFERENCE TO RELATED APPLICATIONS

This application is filed under 35 U.S.C. 0.371 as a National Stage of PCT International Application No. PCT/US2019/020769, filed on Mar. 5, 2019, in the U.S. Patent and Trademark Office, which claims the priority benefit of Korean Patent Application No. 10-2018-0102539, filed on Aug. 30, 2018, in the Korean Intellectual Property Office. The disclosures of PCT International Application No. PCT/US2019/020769 and Korean Patent Application No. 10-2018-0102539 are incorporated by reference herein in their entireties.

BACKGROUND

A printer using an electrophotographic method is a printer in which toner is supplied to an electrostatic latent image formed on a photoconductor to form a visible toner image on the photoconductor, and the toner image is transferred via an intermediate transfer medium or directly to a print medium and then the transferred toner image is fixed on the print medium.

A development cartridge contains the toner, and supplies toner to the electrostatic latent image formed on the photoconductor to form a visible toner image. When the toner contained in the development cartridge is used up, the development cartridge is removed from a body of the printer, and a new development cartridge may be mounted on the main body. The development cartridge may also be refilled with a new toner by using a toner refill kit (toner refill cartridge).

DETAILED DESCRIPTION

Figure 1:
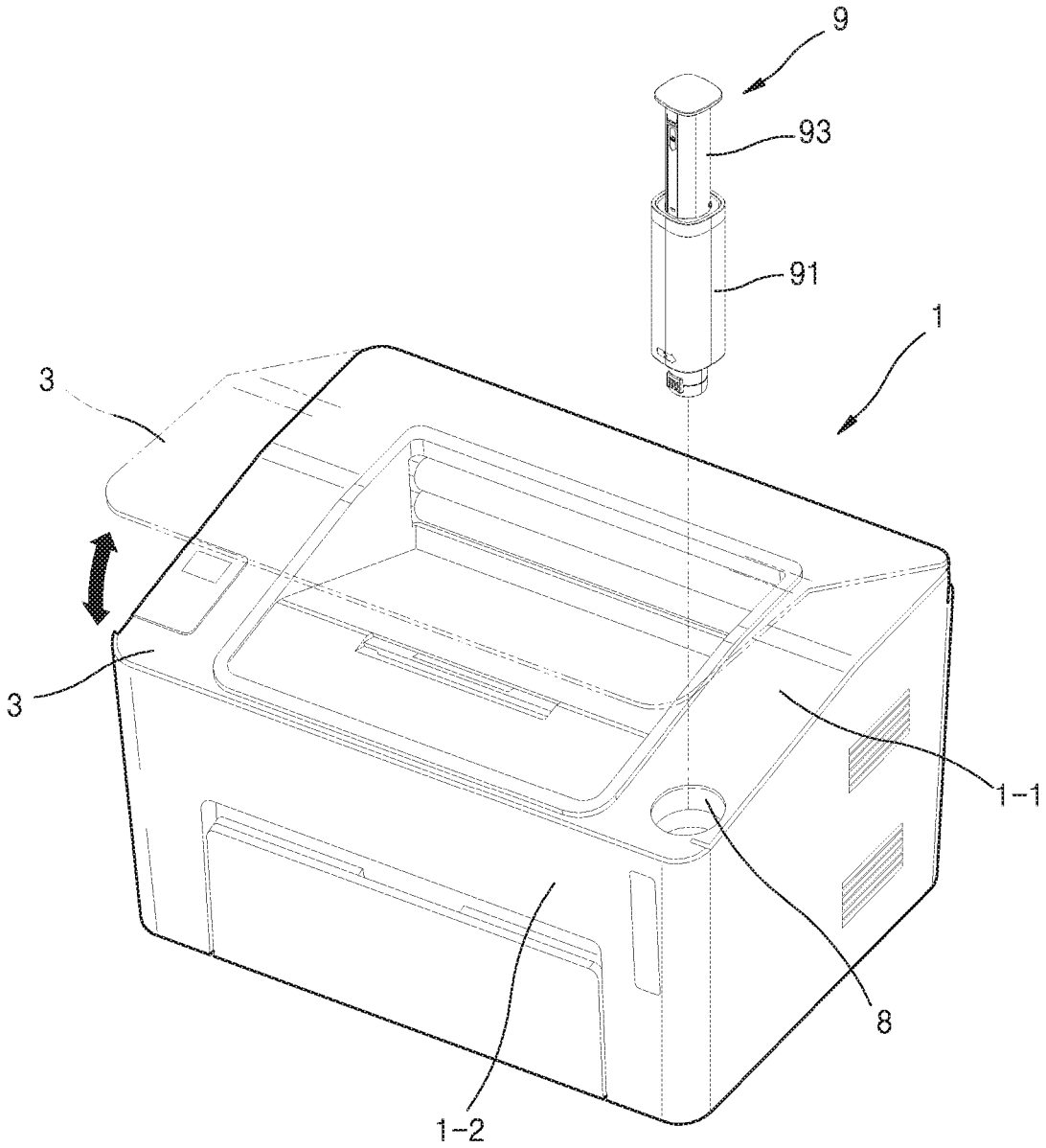
FIG. 1 is a schematic perspective view of the exterior of an electrophotographic printer according to an example.
Figure 2:
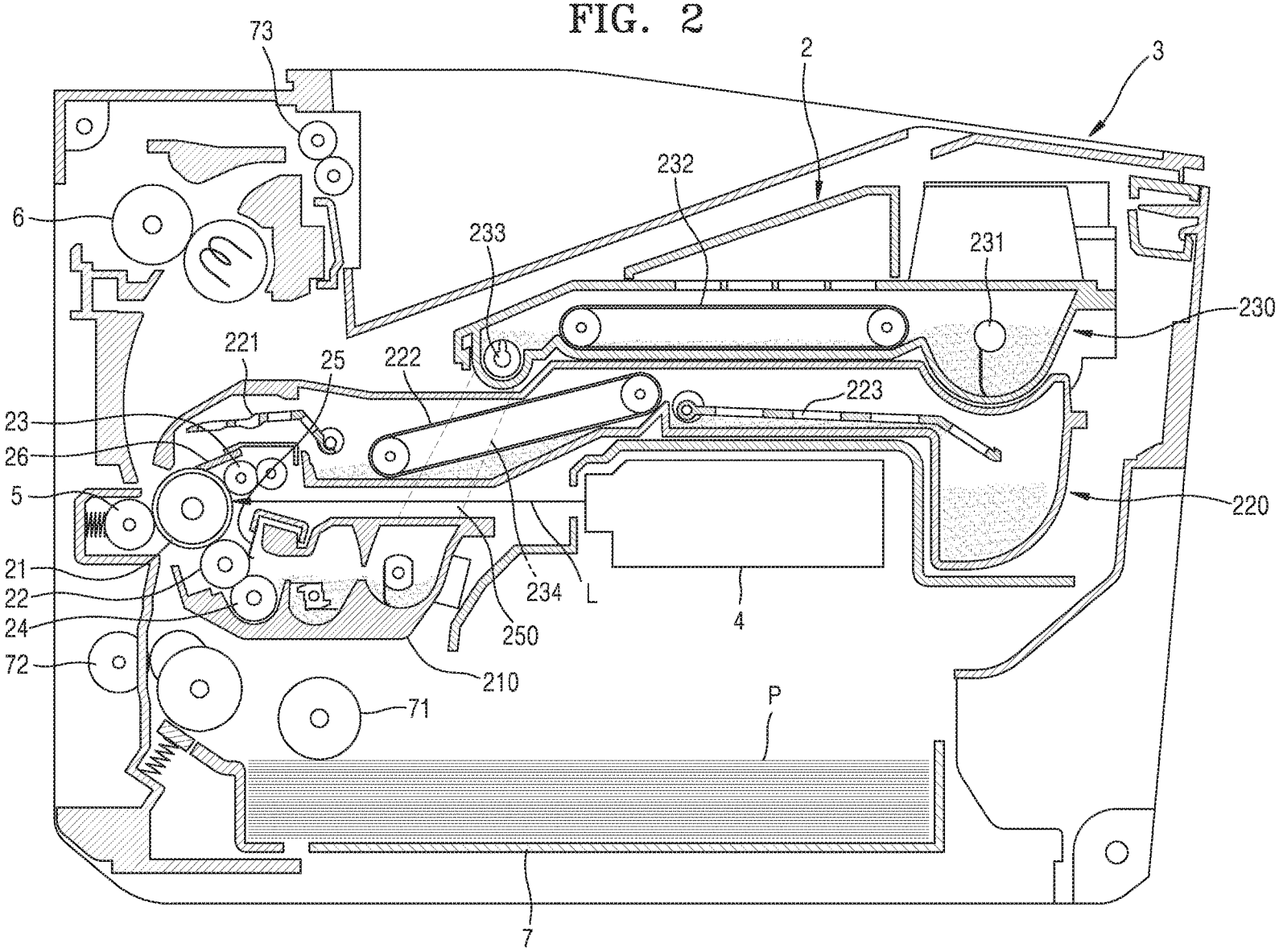
FIG. 2 is a schematic structural diagram of the electrophotographic printer of FIG. 1 according to an example.
Figure 3:
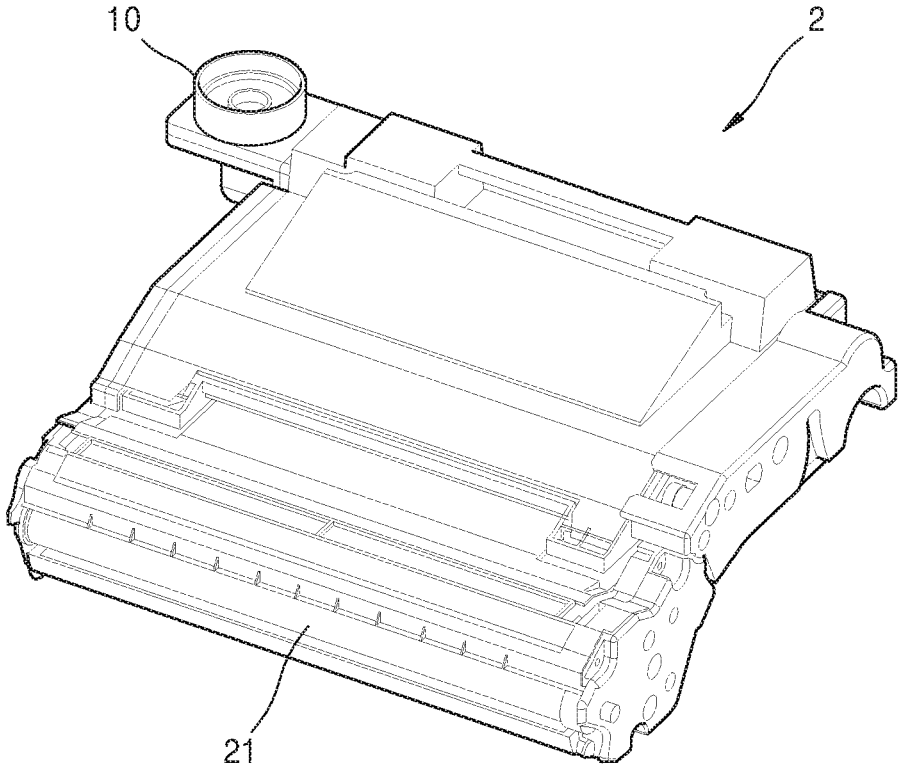
FIG. 3 is a perspective view of a development cartridge included in the electrophotographic printer illustrated in FIG. 1, according to an example.

FIG. 1 is a schematic perspective view of the exterior of an electrophotographic printer according to an example. FIG. 2 is a schematic structural diagram of the electrophotographic printer of FIG. 1 according to an example. FIG. 3 is a perspective view of a development cartridge included in the electrophotographic printer illustrated in FIG. 1, according to an example. Referring to FIGS. 1, 2, and 3, the printer may include a main body 1 and a development cartridge 2 that is attachable to/detachable from the main body 1. A door 3 may be provided in the main body 1. The door 3 opens or closes a portion of the main body 1. While the door 3 opening an upper portion of the main body 1 is illustrated in FIG. 1, a door opening a side portion or a front portion of the main body 1 may be included as needed. The development cartridge 2 may be mounted to or removed from the main body 1 by opening the door 3.

A photosensitive drum 21 is an example of a photoconductor on which an electrostatic latent image is formed, and may include a cylindrical metal pipe and a photoconductive photosensitive layer formed on an outer circumference of the metal pipe. A charging roller 23 is an example of a charger that charges a surface of the photosensitive drum 21 to have a uniform electric potential. A charge bias voltage is applied to the charging roller 23. Instead of the charging roller 23, a corona charger (not shown) may be used. A developing roller 22 supplies toner to an electrostatic latent image formed on a surface of the photosensitive drum 21 to develop the electrostatic latent image.

In a two-component developing method in which toner and a carrier are used as a developer, the developing roller 22 may be in the form of a sleeve inside of which a magnet is fixed. The sleeve may be located apart from the photosensitive drum 21 by tens to hundreds of micrometers. The carrier is attached to an outer circumference of the developing roller 22 via a magnetic force of a magnet, and the toner is attached to the carrier via an electrostatic force, thereby forming a magnetic brush including the carrier and the toner on the outer circumference of the developing roller 22. According to a developing bias applied to the developing roller 22, only the toner is moved to the electrostatic latent image formed on the photosensitive drum 21.

In a one-component developing method in which toner is used as a developer, the developing roller 22 may be in contact with the photosensitive drum 21, and may be located apart from the photosensitive drum 21 by tens to hundreds of micrometers. In the present example, a one-component contact developing method in which the developing roller 22 and the photosensitive drum 21 contact each other to form a developing nip is used. The developing roller 22 may be in the form of an elastic layer (not shown) formed on an outer circumference of a conductive metal core (not shown). When a developing bias voltage is applied to the developing roller 22, the toner is moved via the developing nip, to the electrostatic latent image formed on a surface of the photosensitive drum 21 to be attached to the electrostatic latent image.

A supplying roller 24 attaches the toner to the developing roller 22. A supply bias voltage may be applied to the supplying roller 24 to attach the toner to the developing roller 22. Reference numeral 25 denotes a regulating member regulating a toner amount attached to the surface of the developing roller 22. The regulating member 25 may be, for example, a regulating blade having a front end that contacts the developing roller 22 at a certain pressure. Reference numeral 26 denotes a cleaning member used to remove residual toner and foreign substances from the surface of the photosensitive drum 21 before charging. The cleaning member 26 may be, for example, a cleaning blade having a front end that contacts the surface of the photosensitive drum 21 at a certain pressure. Hereinafter, foreign substances removed from the surface of the photosensitive drum 21 will be referred to as waste toner.

An optical scanner 4 scans light modulated according to image information, onto a surface of the photosensitive drum 21 charged to a uniform electric potential. As the optical scanner 4, for example, a laser scanning unit (LSU) that scans light radiated from a laser diode onto the photosensitive drum 21 by deflecting the light by using a polygon mirror, in a main scanning direction, may be used.

A transfer roller 5 is an example of a transfer unit that is located to face the photosensitive drum 21 to form a transfer nip. A transfer bias voltage used to transfer a toner image developed on the surface of the photosensitive drum 21 to a print medium P is applied to the transfer roller 5. Instead of the transfer roller 5, a corona transfer unit may be used.

The toner image transferred to a surface of the print medium P via the transfer roller 5 is maintained on the surface of the print medium P due to an electrostatic attractive force. A fusing unit 6 fuses the toner image on the print medium P by applying heat and pressure to the toner image, thereby forming a permanent print image on the print medium P.

Referring to FIGS. 2 and 3, the development cartridge 2 according to the present example includes a developing portion 210 in which the photosensitive drum 21 and the developing roller 22 are mounted, a waste toner container 220 receiving waste toner removed from the photosensitive drum 21, and a toner container 230 connected to the developing portion 210 and containing toner. In order to refill toner in the toner container 230, the development cartridge 2 includes a toner refilling portion 10 connected to the toner container 230. The toner refilling portion 10 provides an interface with respect to the toner cartridge 9 which will be described later and the development cartridge 2. The development cartridge 2 is an integrated type development cartridge including the developing portion 210, the waste toner container 220, the toner container 230, and the toner refilling portion 10.

A portion of an outer circumference of the photosensitive drum 21 is exposed outside a housing. A transfer nip is formed as the transfer roller 5 contacts an exposed portion of the photosensitive drum 21. At least one conveying member conveying toner towards the developing roller 22 may be installed in the developing portion 210. The conveying member may also perform a function of charging toner to a certain electric potential by agitating the toner.

The waste toner container 220 is located above the developing portion 210. The waste toner container 220 is spaced apart from the developing portion 210 in an upward direction to form a light path 250 therebetween. Waste toner removed from the photosensitive drum 21 by using the cleaning member 26 is received in the waste toner container 220. The waste toner removed from the surface of the photosensitive drum 21 is fed into the waste toner container 220 via a waste toner feeding member 221, 222, and 223. The shape and number of waste toner feeding members are not limited. An appropriate number of waste toner feeding members may be installed at appropriate locations to distribute waste toner effectively in the waste toner container 220 by considering a volume or shape of the waste toner container 220.

The toner container 230 is connected to the toner refilling portion 10 to receive toner. The toner container 230 is connected to the developing portion 210 via a toner supplier 234 as denoted by a dotted line illustrated in FIG. 2. As illustrated in FIG. 2, the toner supplier 234 may pass through the waste toner container 220 vertically to be connected to the developing portion 210. The toner supplier 234 is located outside an effective width of exposed light L such that the toner supplier 234 does not interfere with the exposed light L scanned in a main scanning direction by using the optical scanner 4.

A toner supplying member 231, 232, and 233 used to supply toner to the developing portion 210 through the toner supplier 234 may be installed in the toner container 230. The shape and number of toner supplying members are not limited. An appropriate number of toner supplying members may be installed at appropriate locations to supply toner effectively to the developing portion 210 by considering a volume or shape of the toner container 230. The toner supplying member 233 may convey toner in a main scanning direction to transfer the same to the toner supplier 234.

An image forming process according to the above-described configuration will be described briefly. A charge bias is applied to the charging roller 23, and the photosensitive drum 21 is charged to a uniform electric potential. The optical scanner 4 scans light modulated in accordance with image information, onto the photosensitive drum 21, thereby forming an electrostatic latent image on a surface of the photosensitive drum 21. The supplying roller 24 attaches the toner to a surface of the developing roller 22. The regulating member 25 forms a toner layer having a uniform thickness on the surface of the developing roller 22. A developing bias voltage is applied to the developing roller 22. As the developing roller 22 is rotated, toner conveyed to a developing nip is moved and attached to the electrostatic latent image formed on the surface of the photosensitive drum 21 via the developing bias voltage, thereby forming a visible toner image on the surface of the photosensitive drum 21. The print medium P withdrawn from a loading tray 7 via a pickup roller 71 is fed, via a feeding roller 72, to the transfer nip where the transfer roller 5 and the photosensitive drum 21 face each other. When a transfer bias voltage is applied to the transfer roller 5, the toner image is transferred to the print medium P via an electrostatic attractive force. As the toner image transferred to the print medium P receives heat and pressure from the fusing unit 6, the toner image is fused to the print medium P, thereby completing printing. The print medium P is discharged by using a discharge roller 73. The toner that is not transferred to the print medium P but remains on the surface of the photosensitive drum 21 is removed by using the cleaning member 26.

As described above, the development cartridge 2 supplies the toner contained in the toner container 230 to the electrostatic latent image formed on the photosensitive drum 21 to form a visible toner image, and is attachable to/detachable from the main body 1. In addition, the development cartridge 2 includes the toner refilling portion 10 used to refill toner. The toner refilling portion 10 may be integrated with the development cartridge 2 and thus may be attachable to/detachable from the main body 1 together with the development cartridge 2. According to the printer of the present example, without removing the development cartridge 2 from the main body 1, toner may be refilled in the development cartridge 2 while the development cartridge 2 is mounted in the main body 1.

Figure 4:
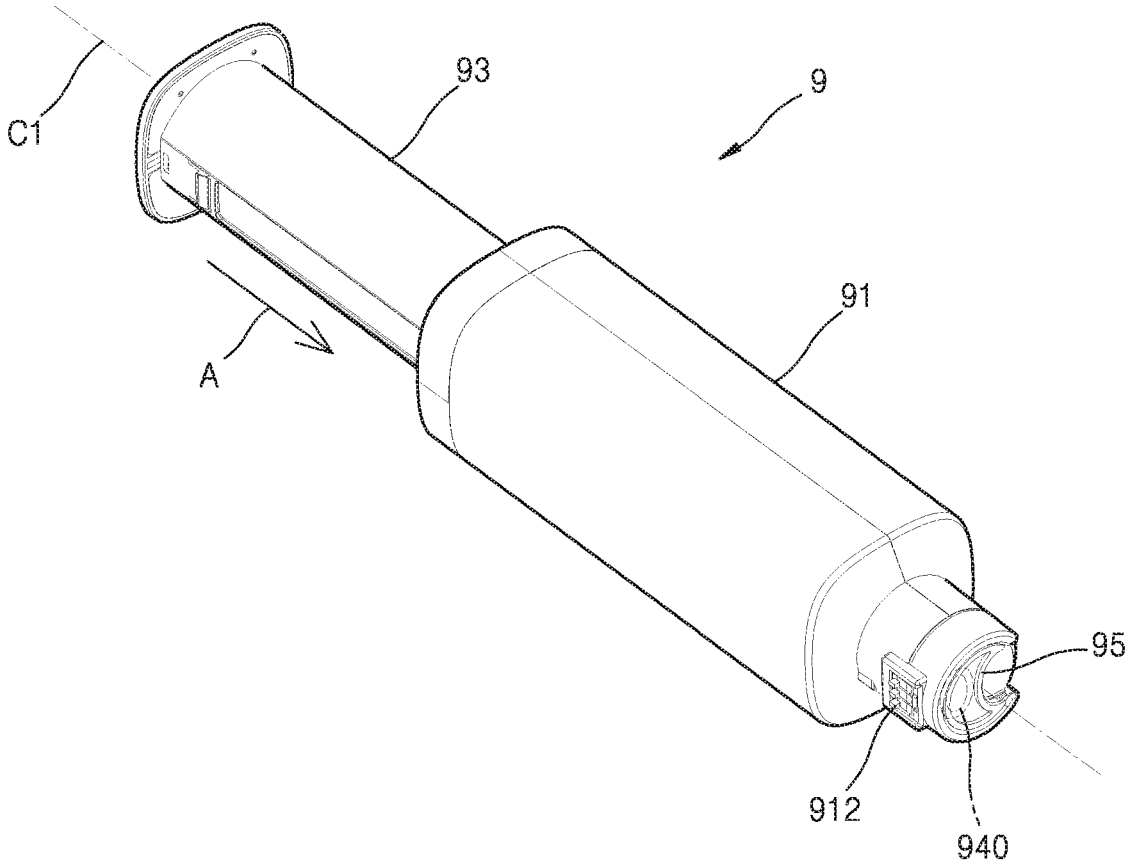
FIG. 4 is a schematic perspective view of a toner cartridge according to an example.
Figure 5:
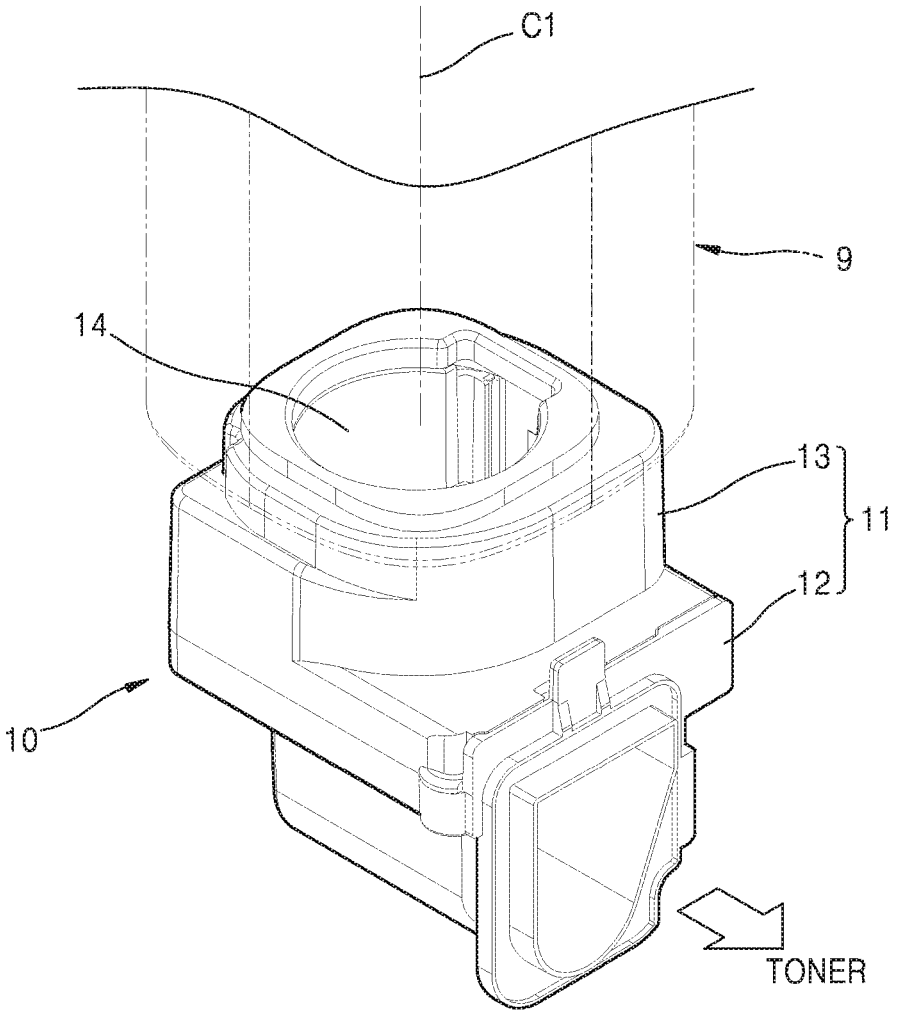
FIG. 5 is a perspective view of a toner refilling portion according to an example.

FIG. 4 is a schematic perspective view of the toner cartridge 9 according to an example. FIG. 5 is a perspective view of the toner refilling portion 10 according to an example. Referring to FIG. 4, the toner cartridge 9 may be a syringe-type toner refill cartridge including a body 91 containing toner and including a toner discharging portion 940 and a plunger 93 that is movably coupled to the body 91 in a length direction A to pull the toner out of the body 91. The toner discharging portion 940 may be provided at a front end portion of the body 91. The discharge shutter 95 selectively opens or closes the toner discharging portion 940. A protruding portion 912 protruding partially and outwardly is provided at the front end portion of the body 91.

Referring to FIG. 1, a communicating portion 8 is provided in the main body 1 to provide access to the development cartridge 2 from the outside when the development cartridge 2 is mounted in the main body 1. The communicating portion 8 may be located relatively close to a front portion 1-2 of the main body 1. As the front portion 1-2 faces a user, the user may easily access the communicating portion 8. Accordingly, a toner refilling job through the communicating portion 8 may be performed easily. The communicating portion 8 may be provided in an upper surface 1-1 of the main body 1. The toner refilling portion 10 is located under the communicating portion 8. The communicating portion 8 and the toner refilling portion 10 may be aligned vertically. The toner cartridge 9 may access the toner refilling portion 10 via the communicating portion 8 from above the main body 1.

For example, when the toner cartridge 9 is inserted into the communicating portion 8 from above the main body 1, as illustrated in FIG. 5, the toner cartridge 9 may be connected to the toner refilling portion 10. When pressing the plunger 93 in direction A while the toner cartridge 9 is mounted in the toner refilling portion 10, the toner received in the body 91 is discharged through the toner discharging portion 940 to be supplied to the toner container 230 of the development cartridge 2 through the toner refilling portion 10. After toner refilling is completed, the toner cartridge 9 is removed from the communicating portion 8.

According to this configuration, as toner is refilled in the toner container 230 by using the toner refilling portion 10, a replacement time of the development cartridge 2 may be extended until the lifetime of the photosensitive drum 21 ends, thereby reducing printing costs per sheet. In addition, toner may be refilled while the development cartridge 2 is mounted in the main body 1, and thus, user convenience may be increased.

Figure 6:
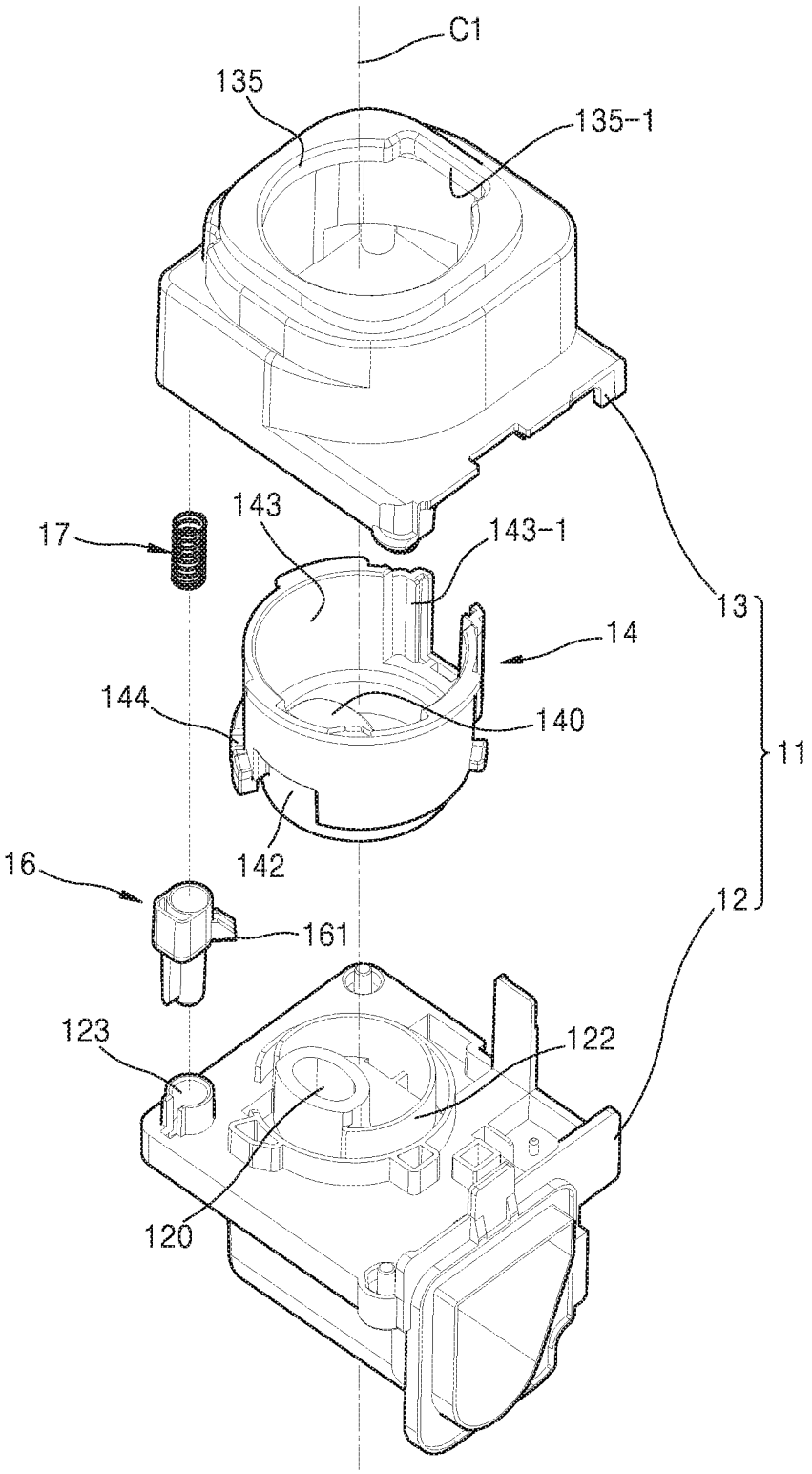
FIG. 6 is an exploded perspective view of a toner refilling portion according to an example.
Figure 7:
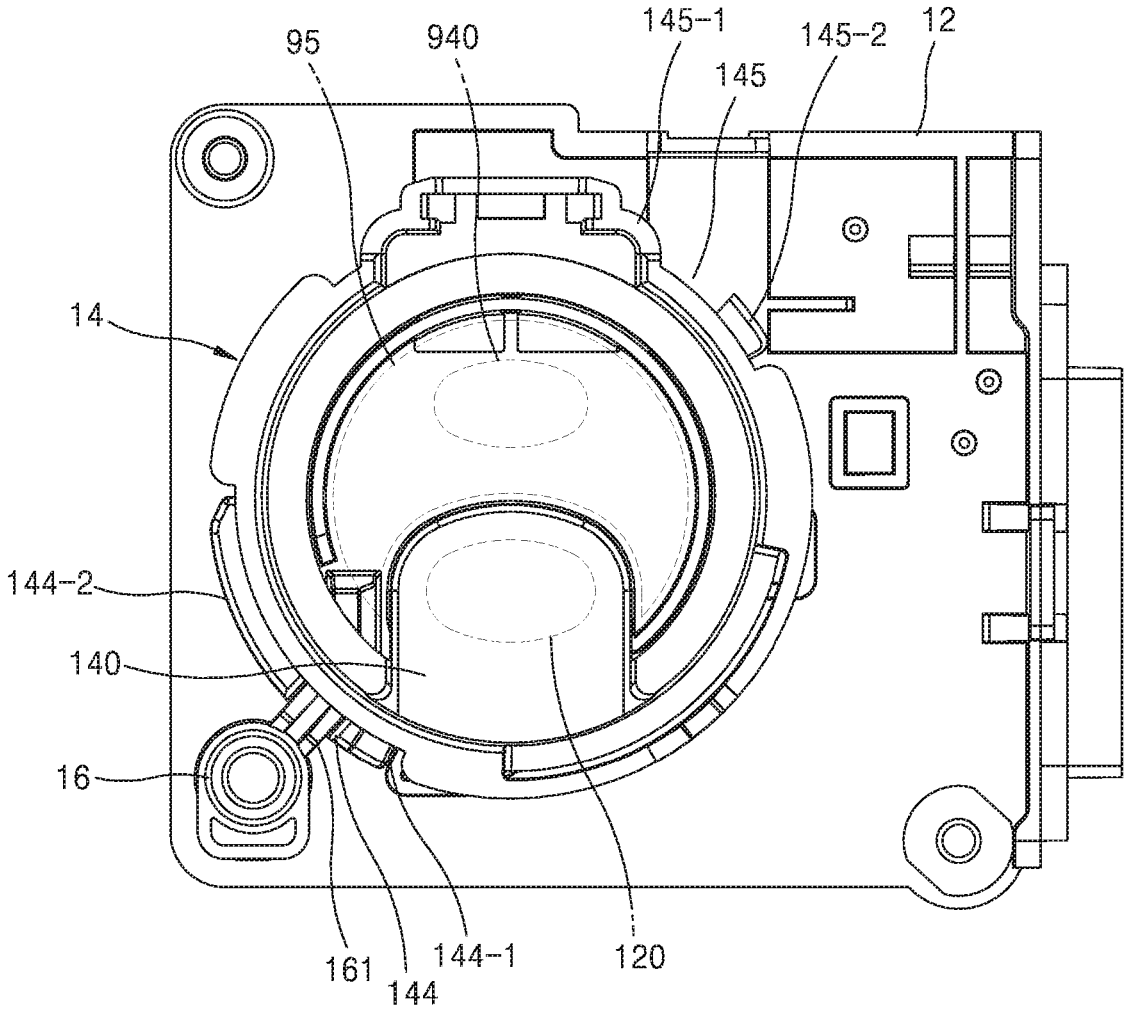
FIG. 7 illustrates an inlet shutter in a blocking position.
Figure 8:
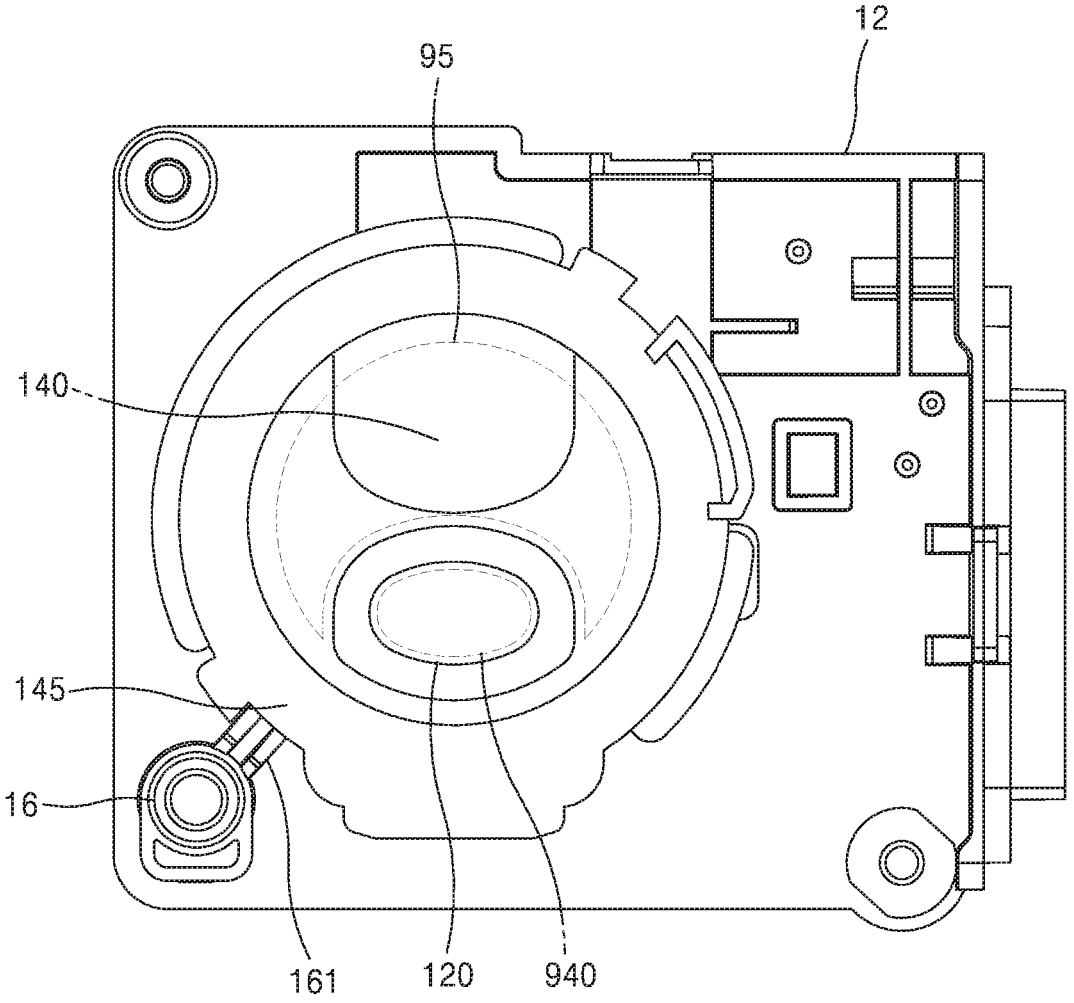
FIG. 8 illustrates an inlet shutter in an inlet position.

FIG. 6 is an exploded perspective view of the toner refilling portion 10 according to an example. FIG. 7 illustrates an inlet shutter 14 located in a blocking position. FIG. 8 illustrates the inlet shutter 14 located in an inlet position. In FIGS. 7 and 8, an upper body 13 is omitted.

Referring to FIGS. 5 and 6, the toner refilling portion 10 may include a mounting portion 11 in which the toner cartridge 9 is mounted, a toner inlet portion 120, and the inlet shutter 14.

The mounting portion 11 is connected to the toner container 230. The toner cartridge 9 that is inserted from outside the mounting portion 11 through the communicating portion 8 is mounted in the mounting portion 11. The toner inlet portion 120 is provided in the mounting portion 11 to receive toner from the toner cartridge 9. For example, the mounting portion 11 may include a lower body 12 and an upper body 13. The upper body 13 is coupled to the lower body 12. The lower body 12 is connected to the toner container 230. The toner inlet portion 120 is provided in the lower body 12.

The inlet shutter 14 is provided in the mounting portion 11 such that it is switchable between a blocking position (FIG. 7) where the toner inlet portion 120 is blocked and an inlet position (FIG. 8) where the toner inlet portion 120 is opened. The inlet shutter 14 may be rotated about a first rotational axis C1 to be switched between the blocking position and the inlet position. For example, the inlet shutter 14 may include a blocking portion 140. The inlet shutter 14 may be provided in the mounting portion 11 such that the inlet shutter 14 is rotatable about the first rotational axis C1 between the blocking position (FIG. 7) where the blocking portion 140 blocks the toner inlet portion 120 and the inlet position (FIG. 8) where the blocking portion 140 is offset from the toner inlet portion 120 to open the toner inlet portion 120.

For example, the inlet shutter 14 may be located between the lower body 12 and the upper body 13. The inlet shutter 14 may be rotatably supported by the lower body 12. A first cylindrical portion 122 that rotatably supports the inlet shutter 14 about the first rotational axis C1 is provided in the lower body 12. The first cylindrical portion 122 may be implemented using, for example, a cylindrical rib arranged about the first rotational axis C1 and protruding toward the upper body 13. The inlet shutter 14 includes a second cylindrical portion 142 surrounding the first cylindrical portion 122 and being rotatably supported by the first cylindrical portion 122. The upper body 13 is coupled to the lower body 12 to cover the inlet shutter 14.

The inlet shutter 14 includes a receiving portion 143 receiving the front end portion of the toner cartridge 9. The inlet shutter 14 has a shape that is rotatable with the toner cartridge 9 when the toner cartridge 9 is rotated about the first rotational axis C1. For example, a shape of the front end portion of the toner cartridge 9 may be complementary to a shape of the blocking portion 140. A groove 143-1 that is partially opened and protrudes outwardly to receive a protruding portion 912 of the toner cartridge 9 may be formed in the receiving portion 143. An insertion portion 135 and a key groove 135-1 that are respectively aligned with the receiving portion 143 and the groove 143-1 may be provided in the upper body 13. The receiving portion 143, the groove 143-1, the insertion portion 135, and the key groove 135-1 are aligned with each other when the inlet shutter 14 is located in the blocking position.

For example, as illustrated in FIG. 7, by aligning the protruding portion 912 with the key groove 135-1 while the inlet shutter 14 is in the blocking position, the toner cartridge 9 may be mounted in the mounting portion 11. Then the front end portion of the body 91 is received in the receiving portion 143 of the inlet shutter 14, and the protruding portion 912 is received in the groove 143-1, and the front end portion of the toner cartridge 9 and the blocking portion 140 are coupled to each other in a complementary manner. The blocking portion 140 covers the toner inlet portion 120. The toner discharging portion 940 of the toner cartridge 9 is located in an offset position from the toner inlet portion 120. The toner discharging portion 940 is blocked by the discharge shutter 95 illustrated in FIG. 4.

In this state, when the toner cartridge 9 is rotated about the first rotational axis C1, the inlet shutter 14 is rotated with the toner cartridge 9. Accordingly, the inlet shutter 14 may be rotated between the blocking position and the inlet position. When the toner cartridge 9 is rotated about the first rotational axis C1 such that the inlet shutter 14 deviates from the blocking position, the protruding portion 912 is located in a lower portion of a boundary of the insertion portion 135 of the upper body 13. In this state, even when attempting to forcibly separate the toner cartridge 9 from the mounting portion 11, since the protruding portion 912 is caught by the insertion portion 135, the toner cartridge 9 is not separated.

When the toner cartridge 9 is rotated about the first rotational axis C1 by 180 degrees, as illustrated in FIG. 8, the inlet shutter 14 is in the inlet position, and the blocking portion 140 is offset from the toner inlet portion 120, thereby opening the toner inlet portion 120. The discharge shutter 95 is caught by an outer portion of the toner inlet portion 120 and is thus not rotated, and the body 91, on the other hand, is rotated with respect to the discharge shutter 95 by 180 degrees. The toner discharging portion 940 of the toner cartridge 9 is opened, and the toner discharging portion 940 is aligned with the toner inlet portion 120. By pressing the plunger 93 in this state, toner may be supplied from the body 91 to the toner container 230 through the toner discharging portion 940 and the toner inlet portion 120.

The development cartridge 2 according to the present example is an integration-type development cartridge 2 in which the toner refilling portion 10 is integrated, as illustrated in FIG. 3. The development cartridge 2 may be distributed during the product distribution stage while being mounted in the main body 1. The development cartridge 2 is a consumable item that is replaced when the life of the development cartridge 2 ends, and may be distributed separately from the main body 1. When the toner inlet portion 120 is opened in a distribution stage, toner contained in the toner container 230 may leak out. The leaked toner may contaminate the toner refilling portion 10. When the toner inlet portion 120 is opened during the distribution stage where the development cartridge 2 is distributed while being mounted in the main body 1, the inside of the main body 1 may be contaminated by the leaked toner.

Considering this, the printer according to the present example includes a first latch member 16 having a first position where the inlet shutter 14 is locked and a second position where switching of the inlet shutter 14 is allowed. A switching unit 18, which will be described later, selectively switches the first latch member 16 between the first position and the second position. In the present example, the first latch member 16 is provided in the toner refilling portion 10, and the switching unit 18 is provided in the main body 1.

Referring to FIGS. 6, 7 and 8, the first latch member 16 may be provided in the mounting portion 11 such that the first latch member 16 is switched between the first position and the second position. The first latch member 16 may be moved in a direction of the first rotational axis C1 to be switched between the first position and the second position. For example, referring to FIG. 6, an operation hole 123 extending in a direction of the first rotational axis C1 may be formed in the lower body 12. The first latch member 16 may be movably inserted into the operation hole 123 in a direction of the first rotational axis C1. A first latch spring 17 applies an elastic force to the first latch member 16 in a direction in which the first latch spring 17 is located in the first position. The first latch spring 17 may be in various forms such as a coil spring, a leaf spring, or a resilient arm integrally formed with the first latch member 16. In the present example, the first latch spring 17 may be implemented by a compression coil spring having a first end portion supported by the upper body 13 and a second end portion supported by the first latch member 16.

The first latch member 16 may lock the inlet shutter 14 in the blocking position. A first latching portion 144 is provided in the inlet shutter 14. The first latching portion 144 may be implemented by a pair of protrusions 144-1 and 144-2 that protrude outward from an outer circumference of the inlet shutter 14 and are spaced apart from each other in a circumferential direction. The first latch member 16 may include a latching protrusion 161 which is caught by the first latching portion 144 when the first latch member 16 is located in the first position. Referring to FIG. 7, when the inlet shutter 14 is located in the blocking position, the latching protrusion 161 of the first latch member 16 located in the first position is caught by the first latching portion 144, and the inlet shutter 14 is locked in the blocking position. The first latch member 16 may be held in the first position via the first latch spring 17 when the development cartridge 2 is separated from the main body 1. Thus, during distribution of the development cartridge 2 while being mounted in the main body 1 or apart from the main body 1, the toner inlet portion 120 may be maintained in a closed state, and thus, toner leakage may be prevented.

When the toner cartridge 9 is mounted in the mounting portion 11 and is rotated during refilling of toner, the inlet shutter 14 is also rotated so that the toner inlet portion 120 and the toner discharging portion 940 may be offset from each other. Then, the toner discharged through the toner discharging portion 940 may leak out of the toner inlet portion 120 to contaminate the toner refilling portion 10.

Considering this, the first latch member 16 may lock the inlet shutter 14 in the inlet position. Referring to FIGS. 7 and 8, a second latching portion 145 is provided on the inlet shutter 14. The second latching portion 145 may be implemented using a pair of protrusions 145-1 and 145-2 that protrude outwardly from the outer circumference of the inlet shutter 14 and are spaced apart from each other in a circumferential direction. As illustrated in FIG. 8, when the inlet shutter 14 is located in the inlet position, the latching protrusion 161 of the first latch member 16 located in the first position is caught by the second latching portion 145, and the inlet shutter 14 is locked in the inlet position. Accordingly, while the toner cartridge 9 is mounted in the mounting portion 11 and toner is being refilled, the inlet shutter 14 is not rotated, and the toner may be stably refilled in the toner container 230 without toner leakage.

The switching unit 18 selectively switches the first latch member 16 between the first position and the second position. For example, while the inlet shutter 14 is locked in the blocking position, when the toner cartridge 9 is mounted in the toner refilling portion 10, the switching unit 18 switches the first latch member 16 to the second position so that the inlet shutter 14 and the toner cartridge 9 may be rotated together. When the first latch member 16 is located in the second position, the latching protrusion 161 deviates from the first latching portion 144, and the inlet shutter 14 enters a state where it is rotatable. When the toner cartridge 9 is mounted in the toner refilling portion 10 and rotated by 180 degrees, so that the inlet shutter 14 is located in the inlet shutter 14, the switching unit 18 may switch the first latch member 16 to the first position. The latching protrusion 161 of the first latch member 16 is caught by the second latching portion 145 and the inlet shutter 14 is locked in the inlet position, and thus the toner cartridge 9 and the inlet shutter 14 are not rotated.

Figure 9:
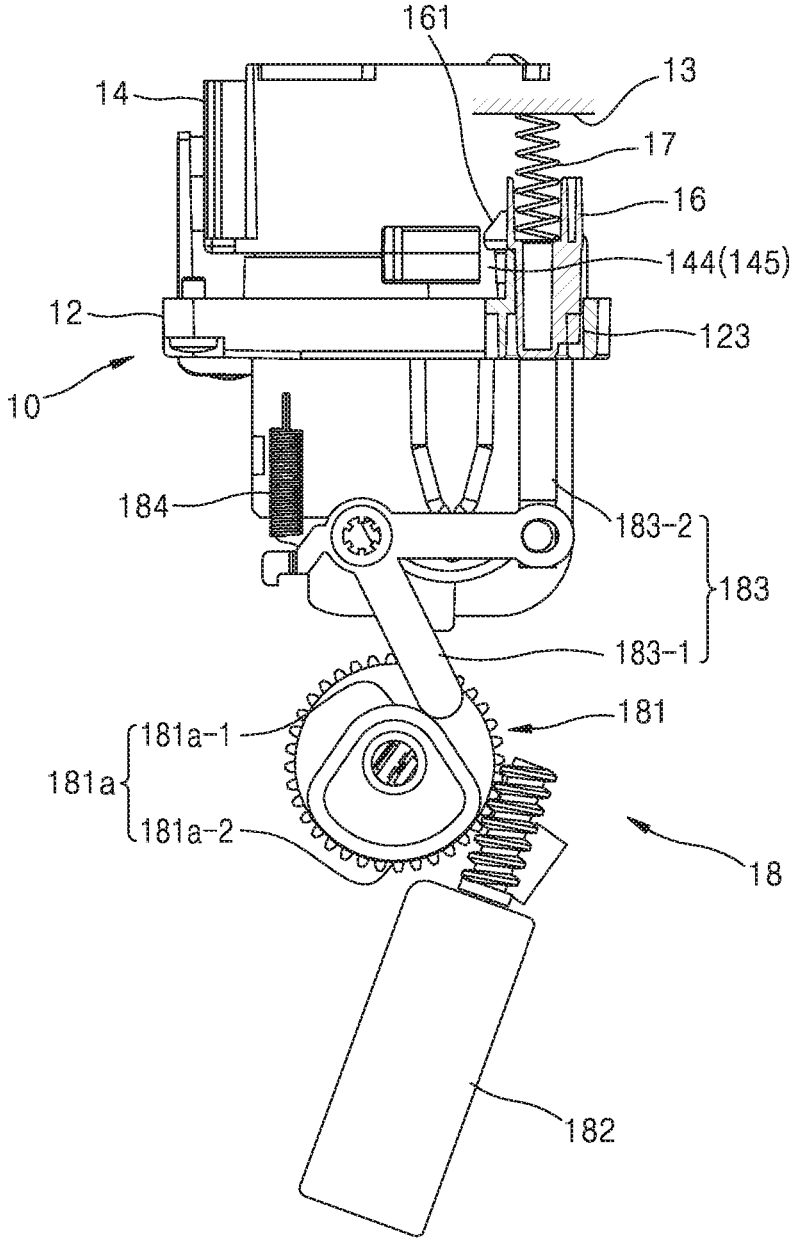
FIG. 9 is a schematic structural diagram of a switching unit according to an example, in which a first latch member is in a first position.
Figure 10:
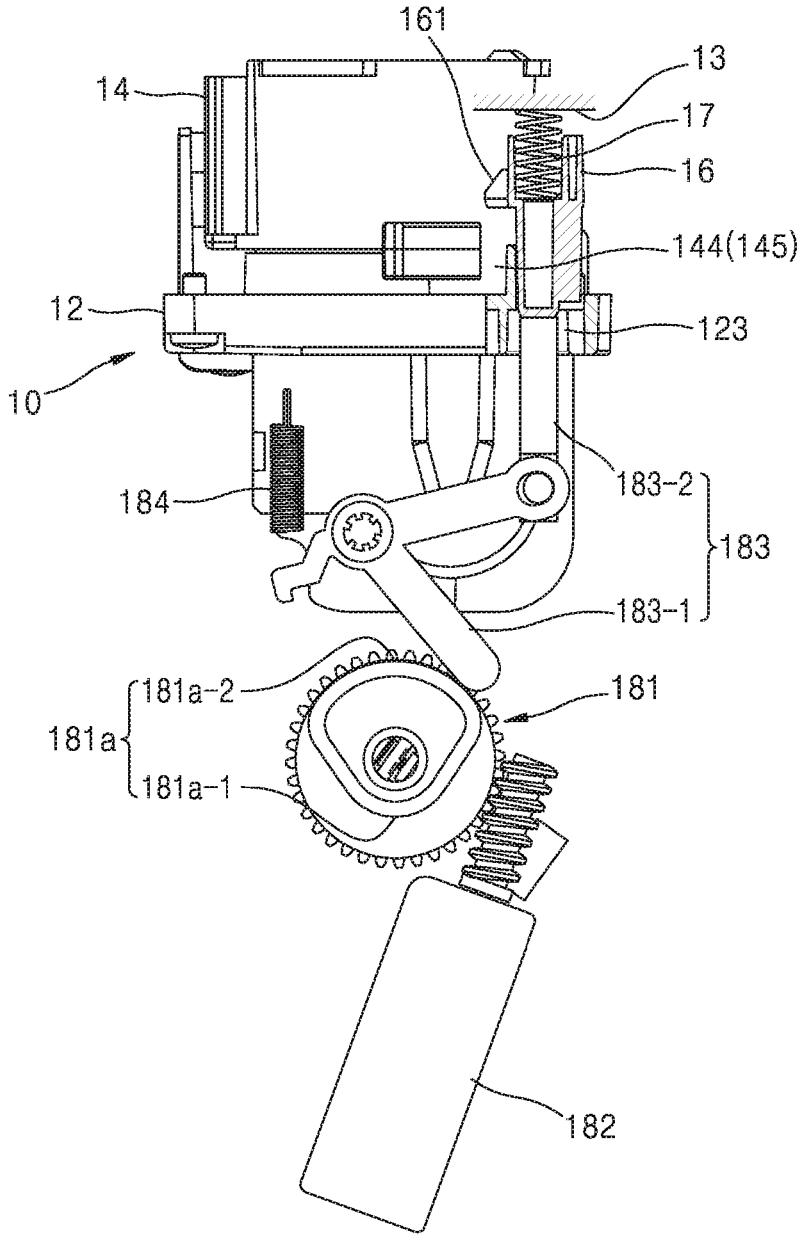
FIG. 10 is a schematic structural diagram of a switching unit according to an example, showing a first latch member in a second position.
Figure 11:
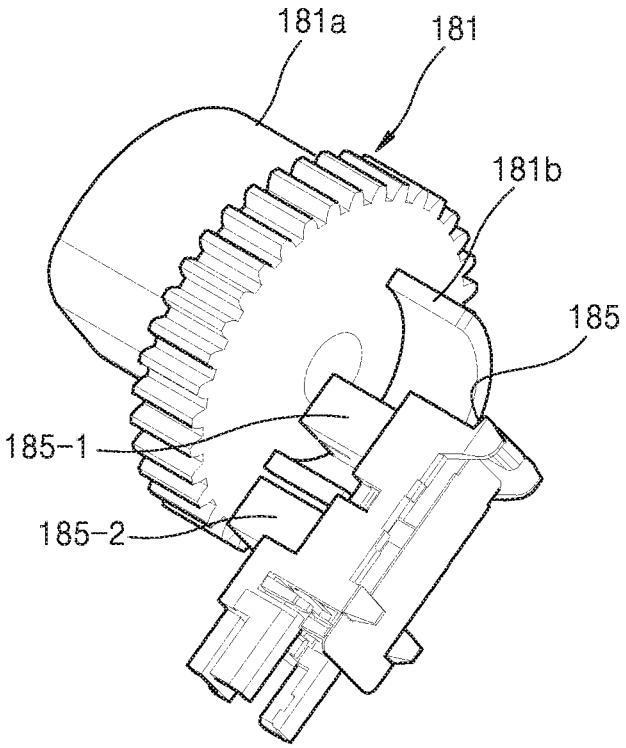
FIG. 11 illustrates a structure of detecting a phase of a rotational cam according to an example.

The switching unit 18 may be implemented in various forms. FIG. 9 is a schematic structural diagram of the switching unit 18 according to an example, showing the first latch member 16 located in the first position. FIG. 10 is a schematic structural diagram of the switching unit 18 according to an example, showing the first latch member 16 located in the second position. FIG. 11 illustrates a structure of detecting a phase of a rotational cam 181 according to an example. In FIGS. 9 and 10, the upper body 13 is omitted.

Referring to FIGS. 9 and 10, the switching unit 18 includes a rotational cam 181 having a cam track 181*a*, a motor 182 rotating the rotational cam 181, and a movable member 183 guided to the cam track 181*a* to switch the first latch member 16 between the first and second positions. The cam track 181*a* may include first and second cam portions 181*a*-1 and 181*a*-2 respectively corresponding to the first and second positions of the first latch member 16. The movable member 183 may include a first movable member 183-1 guided to the cam track 181*a* to be pivoted and a second movable member 183-2 connected to the first movable member 183-1 to be lifted. When the development cartridge 2 is mounted in the main body 1, the second movable member 183-2 may be inserted into the operation hole 123 in which the first latch member 16 is installed, to thereby contact the first latch member 16. The cam spring 184 applies an elastic force to the movable member 183 in a direction in which the movable member 183 contacts the cam track 181*a*. According to the present example, the cam spring 184 is implemented by using a tensile coil spring having a first end portion connected to the first movable member 183-1 and a second end portion supported by the main body 1. The first end portion of the first movable member 183-1 is maintained in contact with the cam track 181*a* via the cam spring 184. The motor 182 may be, for example, a direct current (DC) motor. For example, a worm gear may be mounted on a rotational axis of the motor 182. A worm wheel with which the worm gear engages may be provided to the rotational cam 181. When the motor 182 rotates, the rotational cam 181 may be rotated.

Referring to FIG. 11, the switching unit 18 may further include a sensor 185 detecting a phase of the rotational cam 181. For example, the sensor 185 may be implemented using a photo-interrupter including a light emitting portion 185-1 and a light receiving portion 185-2. A light shielding rib 181*b* blocking light between the light emitting portion 185-1 and the light receiving portion 185-2 according to a rotational phase may be provided in the rotational cam 181. For example, when light is blocked via the light shielding rib 181*b* and thus no light is detected from the light receiving portion 185-2, an ON detection signal may be generated in the light receiving portion 185-2; when light is detected from the light receiving portion 185-2, an OFF detection signal may be generated in the light receiving portion 185-2. For example, when an angle between two ends of the light shielding rib 181*b* is 180 degrees, the movable member 183 may be configured to be guided to the first cam portion 181*a*-1 of the rotational cam 181 in a moment when a detection signal of the light receiving portion 185-2 changes from ON to OFF, and the movable member 183 may be configured to be guided to the second cam portion 181*a*-2 of the rotational cam 181 in a moment when a detection signal of the light receiving portion 185-2 changes from OFF to ON. According to this configuration, a rotational phase of the rotational cam 181 may be detected, and the first latch member 16 may be positioned in the first position or the second position.

The motor 182 is driven in an initial state and stopped a moment when a detection signal of the light receiving portion 185-2 changes from ON to OFF. Then the movable member 183 is guided to the first cam portion 181*a*-1, and the movable member 183 moves away from the first latch member 16, and accordingly, due to an elastic force of the first latch spring 17, the first latch member 16 is located in the first position as illustrated in FIG. 9. As the latching protrusion 161 of the first latch member 16 is caught by the first latching portion 144 or the second latching portion 145 of the inlet shutter 14, the inlet shutter 14 is locked in the blocking position or the inlet position.

To allow rotation of the inlet shutter 14, the motor 182 is driven and then stopped a moment when a detection signal of the light receiving portion 185-2 changes from OFF to ON. Then the movable member 183 is guided to the second cam portion 181*a*-2, and the movable member 183 pushes the first latch member 16 in an opposite direction to the elastic force of the first latch spring 17. Then, as illustrated in FIG. 10, the first latch member 16 is located in the second position. As the latching protrusion 161 of the first latch member 16 deviates upwards from the first latching portion 144 or second latching portion 145 of the inlet shutter 14, the inlet shutter 14 may be rotated from the blocking position to the inlet shutter 14 or in an opposite direction thereto.

Figure 12:
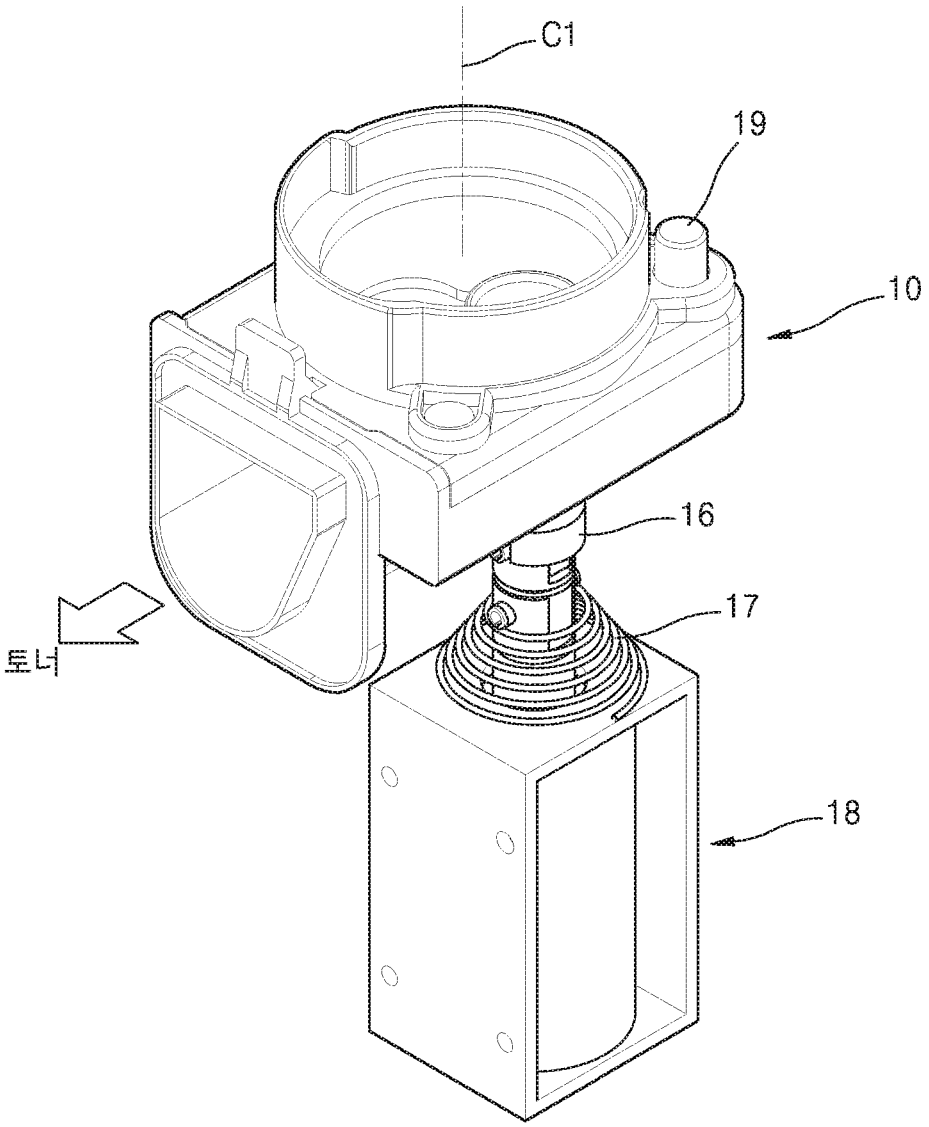
FIG. 12 is a perspective view of a structure in which a first latch member and a switching unit are provided in a main body, according to an example.
Figure 13:
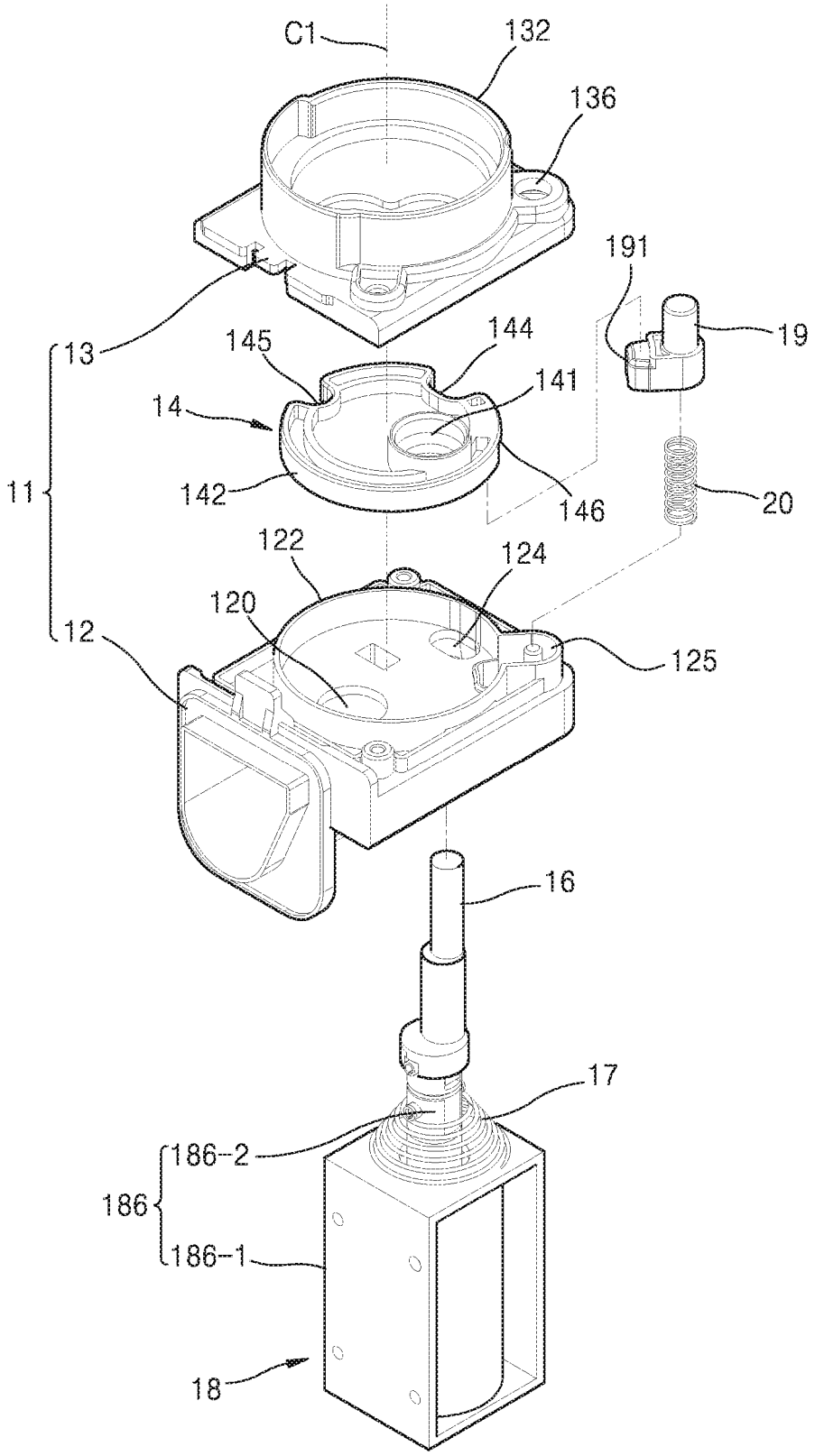
FIG. 13 is an exploded perspective view of the structure in which the first latch member and the switching unit are provided in the main body, illustrated in FIG. 12, according to an example.
Figure 14:
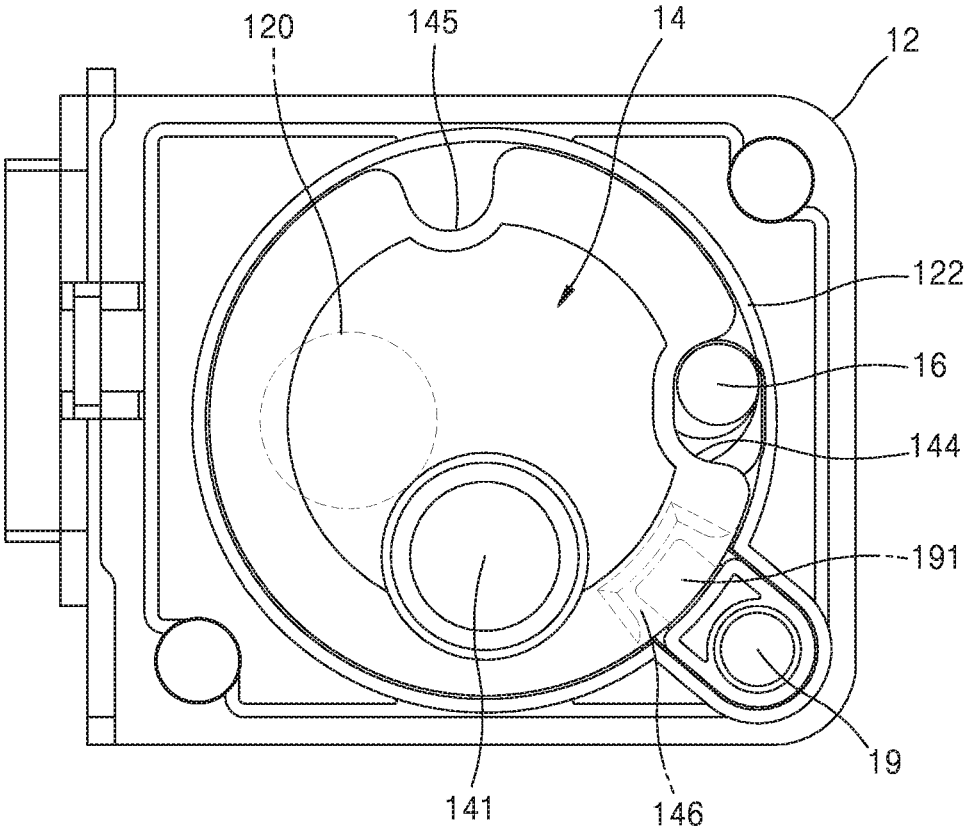
FIG. 14 illustrates an inlet shutter in a blocking position.
Figure 15:
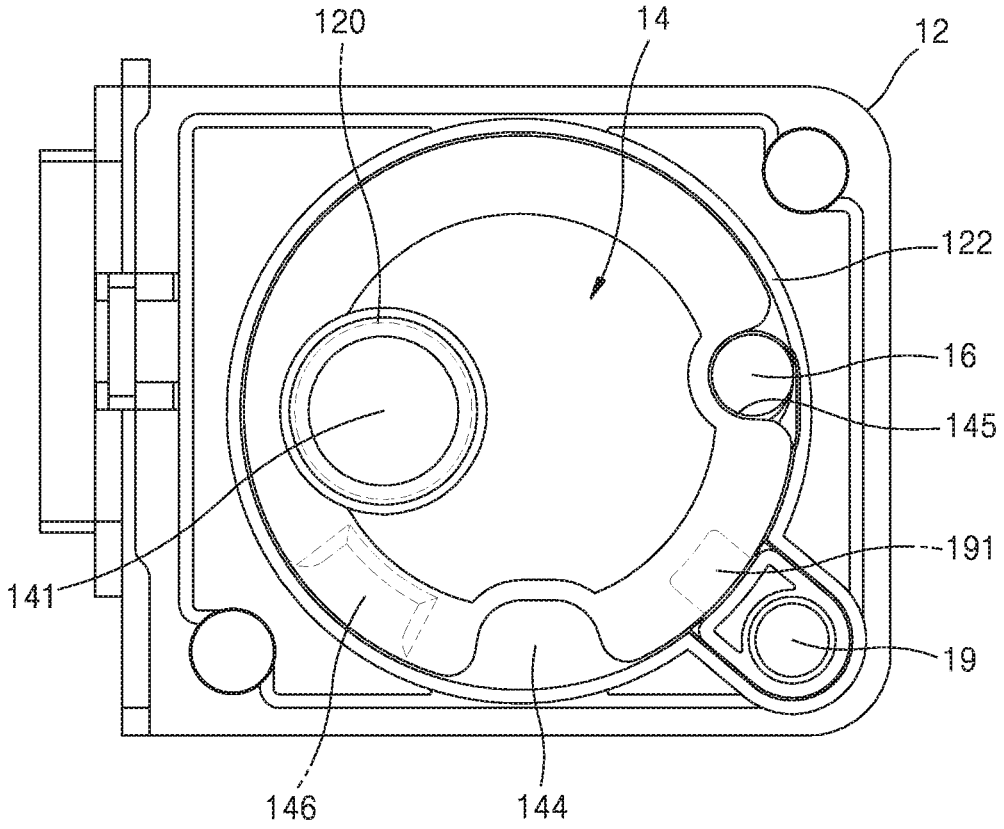
FIG. 15 illustrates an inlet shutter in an inlet position.
Figure 16:
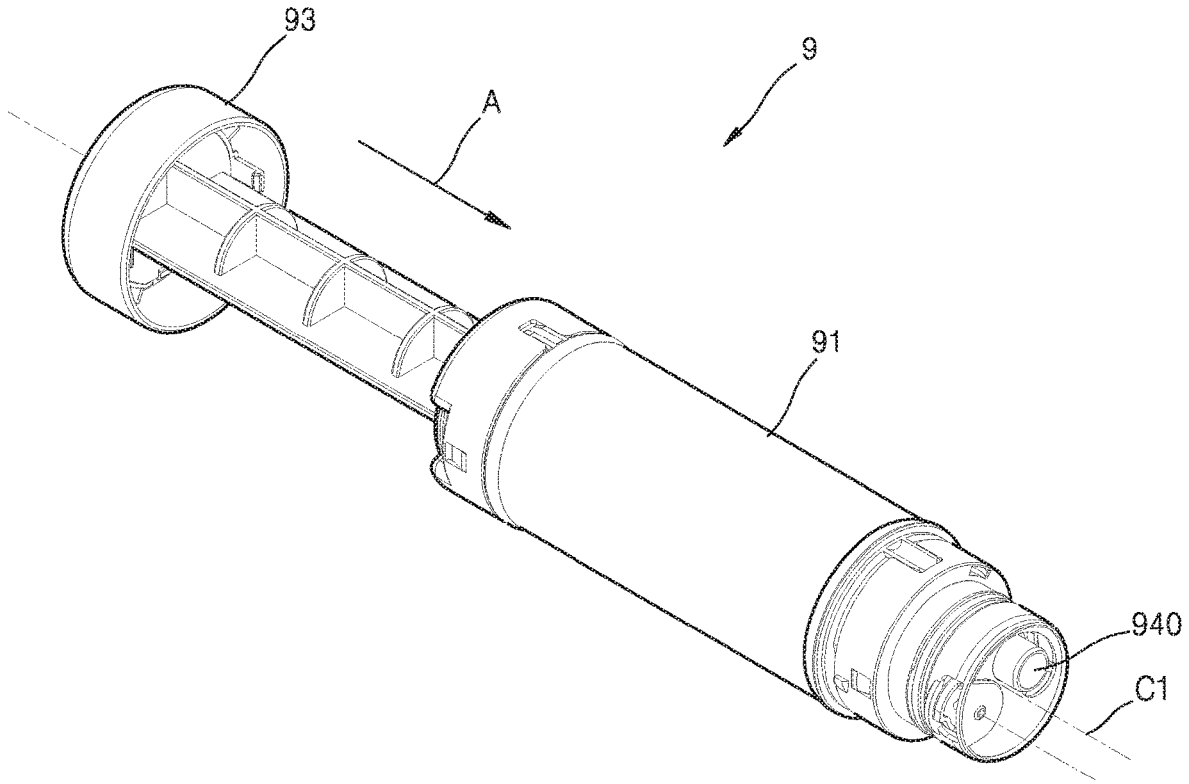
FIG. 16 is a schematic perspective view of a toner cartridge according to an example.

The first latch member 16 and the switching unit 18 may also be provided in the main body 1. FIG. 12 is a perspective view of a structure in which the first latch member 16 and the switching unit 18 are provided in the main body 1, according to an example. FIG. 13 is an exploded perspective view of the structure of FIG. 12. FIG. 14 illustrates the inlet shutter 14 located in the blocking position. FIG. 15 illustrates the inlet shutter 14 located in the inlet position. FIG. 16 is a schematic perspective view of the toner cartridge 9 according to an example. In FIGS. 12 and 13, only the toner refilling portion 10, the first latch member 16, and the switching unit 18 are illustrated. In FIGS. 14 and 15, the upper body 13 is omitted. Elements having an identical function as those described in the above-described examples will be labeled with identical reference numerals.

Referring to FIG. 16, the toner cartridge 9 may be a syringe-type toner refill cartridge including a body 91 containing toner and including a toner discharging portion 940 and a plunger 93 that is movably coupled to the body 91 in a length direction A to pull the toner out of the body 91. The toner discharging portion 940 may be provided at a front end portion of the body 91. The toner discharging portion 940 may be eccentrically positioned from the first rotational axis C1. The body 91 may be, for example, cylindrical. The first rotational axis C1 may be a central axis of a cylindrical body 91. The first rotational axis C1 may be a rotational central axis about which the toner cartridge 9 mounted on the toner refilling portion 10 is rotated. A discharge shutter (not shown) selectively opens or closes the toner discharging portion 940. When pressing the plunger 93 in direction A while the toner cartridge 9 is mounted in the toner refilling portion 10, the toner may be supplied from the body 91 to the toner container 230 of the development cartridge 2 through the toner refilling portion 10.

Referring to FIGS. 12, 13, 14, and 15, the toner refilling portion 10 may include a mounting portion 11 in which the toner cartridge 9 is mounted, a toner inlet portion 120, and an inlet shutter 14.

The mounting portion 11 is connected to the toner container 230. The toner cartridge 9 that is inserted from outside the mounting portion 11 through the communicating portion 8 is mounted in the mounting portion 11. A toner inlet portion 120 is provided in the mounting portion 11 to receive toner from the toner cartridge 9. For example, the mounting portion 11 may include a lower body 12 and an upper body 13. The upper body 13 is coupled to the lower body 12. The lower body 12 is connected to the toner container 230. The toner inlet portion 120 is provided in the lower body 12.

The inlet shutter 14 is provided in the mounting portion 11 such that the inlet shutter 14 is switchable between the blocking position (FIG. 14) where the toner inlet portion 120 is blocked and the inlet position (FIG. 15) where the toner inlet portion 120 is opened. The inlet shutter 14 may be rotated about the first rotational axis C1 between the blocking position and the inlet position. For example, the inlet shutter 14 may include a second toner inlet portion 141. The inlet shutter 14 may be provided in the mounting portion 11 such that the inlet shutter 14 is rotatable about the first rotational axis C1 between the blocking position where the toner inlet portion 120 and the second toner inlet portion 141 are offset from each other to block the toner inlet portion 120 and the inlet position where the toner inlet portion 120 and the second toner inlet portion 141 are aligned with each other to open the toner inlet portion 120. The second toner inlet portion 141 is aligned with the toner discharging portion 940 of the toner cartridge 9.

For example, the inlet shutter 14 may be located between the lower body 12 and the upper body 13. The inlet shutter 14 may be rotatably supported by the lower body 12. The lower body 12 has a first cylindrical portion 122 that rotatably supports the inlet shutter 14 about the first rotational axis C1. The first cylindrical portion 122 may be, for example, a cylindrical rib arranged about the first rotational axis C1 and protruding toward the upper body 13. The inlet shutter 14 is supported by the lower body 12 such that the second cylindrical portion 142 forming an outer circumference of the inlet shutter 14 is located within the first cylindrical portion 122. The upper body 13 is coupled to the lower body 12 to cover the inlet shutter 14.

The upper body 13 may have a structure in which the toner cartridge 9 may be rotatably supported. For example, a receiving portion 132 having a cylindrical shape and receiving the front end portion of the toner cartridge 9 may be provided in the upper body 13. The receiving portion 132 may be, for example, a cylindrical rib arranged about the first rotational axis C1 and protruding upwardly. When the toner cartridge 9 is mounted in the mounting portion 11, the front end portion of the toner cartridge 9 is received in the receiving portion 132, and the toner discharging portion 940 is inserted into the second toner inlet portion 141 of the inlet shutter 14. In this state, when the toner cartridge 9 is rotated about the first rotational axis C1, the inlet shutter 14 is rotated with the toner cartridge 9. Accordingly, the inlet shutter 14 may be rotated between the blocking position and the inlet position.

As illustrated in FIG. 14, while the inlet shutter 14 is located in the blocking position, the toner cartridge 9 is mounted in the mounting portion 11. The toner discharging portion 940 is inserted into the second toner inlet portion 141. As the second toner inlet portion 141 and the toner inlet portion 120 are offset from each other, even when a discharge shutter opens the toner discharging portion 940, toner does not flow into the toner inlet portion 120. In this state, when the toner cartridge 9 is rotated about the first rotational axis C1 by 90 degrees, as illustrated in FIG. 15, the inlet shutter 14 is in the inlet position, and the second toner inlet portion 141 is aligned with the toner inlet portion 120, thereby opening the toner inlet portion 120. When the discharge shutter (not shown) opens the toner discharging portion 940 and presses the plunger 93, toner may be supplied to the toner container 230 from the body 91 through the toner discharging portion 940, the second toner inlet portion 141, and the toner inlet portion 120.

The printer according to the present example includes the first latch member 16 having a first position where the inlet shutter 14 is locked and a second position where switching of the inlet shutter 14 is allowed. The switching unit 18 selectively switches the first latch member 16 between the first position and the second position. According to the present example, the first latch member 16 and the switching unit 18 are provided in the main body 1.

Referring to FIG. 13, the first latch member 16 may be moved in a direction of the first rotational axis C1 to be switched between the first position and the second position. When the development cartridge 2 is mounted in the main body 1, the first latch member 16 is inserted, for example, into a through hole 124 provided in the lower body 12.

The first latch member 16 may lock the inlet shutter 14 in the blocking position. Referring to FIGS. 13 and 14, a first latching portion 144 whereby the first latch member 16 located in the first position is caught when the inlet shutter 14 is located in the blocking position is provided in the inlet shutter 14. When the inlet shutter 14 is located in the blocking position, the first latching portion 144 is aligned with the first latch member 16, and when the first latch member 16 is switched to the first position via the switching unit 18 which will be described later, the first latch member 16 may be caught by the first latching portion 144, thereby locking the inlet shutter 14 in the blocking position. Thus, during distribution of the development cartridge 2 mounted in the main body 1, the toner inlet portion 120 may be maintained in a closed state, and thus, toner leakage may be prevented.

The first latch member 16 may lock the inlet shutter 14 in the inlet position. Referring to FIGS. 13 and 15, the second latching portion 145 whereby the first latch member 16 located in the first position is caught when the inlet shutter 14 is located in the inlet position is provided in the inlet shutter 14. When the inlet shutter 14 is located in the inlet position, the second latching portion 145 is aligned with the first latch member 16, and when the first latch member 16 is switched to the first position via the switching unit 18 which will be described later, the first latch member 16 may be caught by the second latching portion 145, thereby locking the inlet shutter 14 in the inlet position. Accordingly, while the toner cartridge 9 is mounted in the mounting portion 11 and toner is being refilled, the inlet shutter 14 is not rotated, and the toner may be stably refilled in the toner container 230 without toner leakage.

Referring to FIGS. 12 and 13, the switching unit 18 may include a solenoid 186 via which the first latch member 16 is switched between the first and second positions. The solenoid 186 may include a solenoid body 186-1 and a driving shaft 186-2. The first latch member 16 is connected to the driving shaft 186-2. A first latch spring 17 applies an elastic force to the first latch member 16 in a direction in which the first latch member 16 is located in the first position. According to the present example, the first latch spring 17 is implemented by a compression coil spring interposed between the driving shaft 186-2 and the solenoid body 186-1. The first latch spring 17 applies an elastic force to the driving shaft 186-2 in a direction in which the first latch member 16 is located in the first position. That is, the first latch spring 17 pushes the driving shaft 186-2 towards the first latch member 16.

When a current is supplied to the solenoid body 186-1, the driving shaft 186-2 is pulled in an opposite direction of the elastic force of the first latch spring 17, that is, toward the solenoid body 186-1. The first latch member 16 is moved from the first position to the second position. When no current is applied to the solenoid body 186-1, the driving shaft 186-2 is pushed toward the first latch member 16 due to the elastic force of the first latch spring 17 and the first latch member 16 is moved from the second position to the first position.

As described above, according to the switching unit 18 including the solenoid 186, by supplying or blocking a current to or from the solenoid 186, the first latch member 16 may be switched between the second position and the first position.

Referring back to FIGS. 12 and 13, a third latching portion 146 may be provided in the inlet shutter 14. A second latch member 19 has a third position where the second latch member 19 is caught by the third latching portion 146 when the inlet shutter 14 is located in the blocking position to lock the inlet shutter 14 and a fourth position where the second latch member 19 is released from the third latching portion 146. For example, the second latch member 19 may be liftably mounted in a direction of the first rotational axis C1 in the operation hole 125 of the lower body 12 that extends in a direction of the first rotational axis C1. The third latching portion 146 may be concavely formed in an upward direction from a lower surface of the inlet shutter 14. A latching portion 191 that is caught by the third latching portion 146 when the second latch member 19 is located in the third position is formed on the second latch member 19. A second latch spring 20 applies an elastic force to the second latch member 19 in a direction in which the second latch member 19 is located in the third position. Thus, when the development cartridge 2 is separated from the main body 1, the second latch member 19 may be maintained in the third position.

When the first latch member 16 and the switching unit 18 are provided in the main body 1, and when the development cartridge 2 is separated from the main body 1, the inlet shutter 14 may not be locked in the blocking position. In addition, also when the development cartridge 2 is distributed separately from the main body 1, the inlet shutter 14 may not be locked in the blocking position. According to the present example, when the development cartridge 2 is separated from the main body 1, the inlet shutter 14 may be locked in the blocking position via the second latch member 19.

Figure 17:
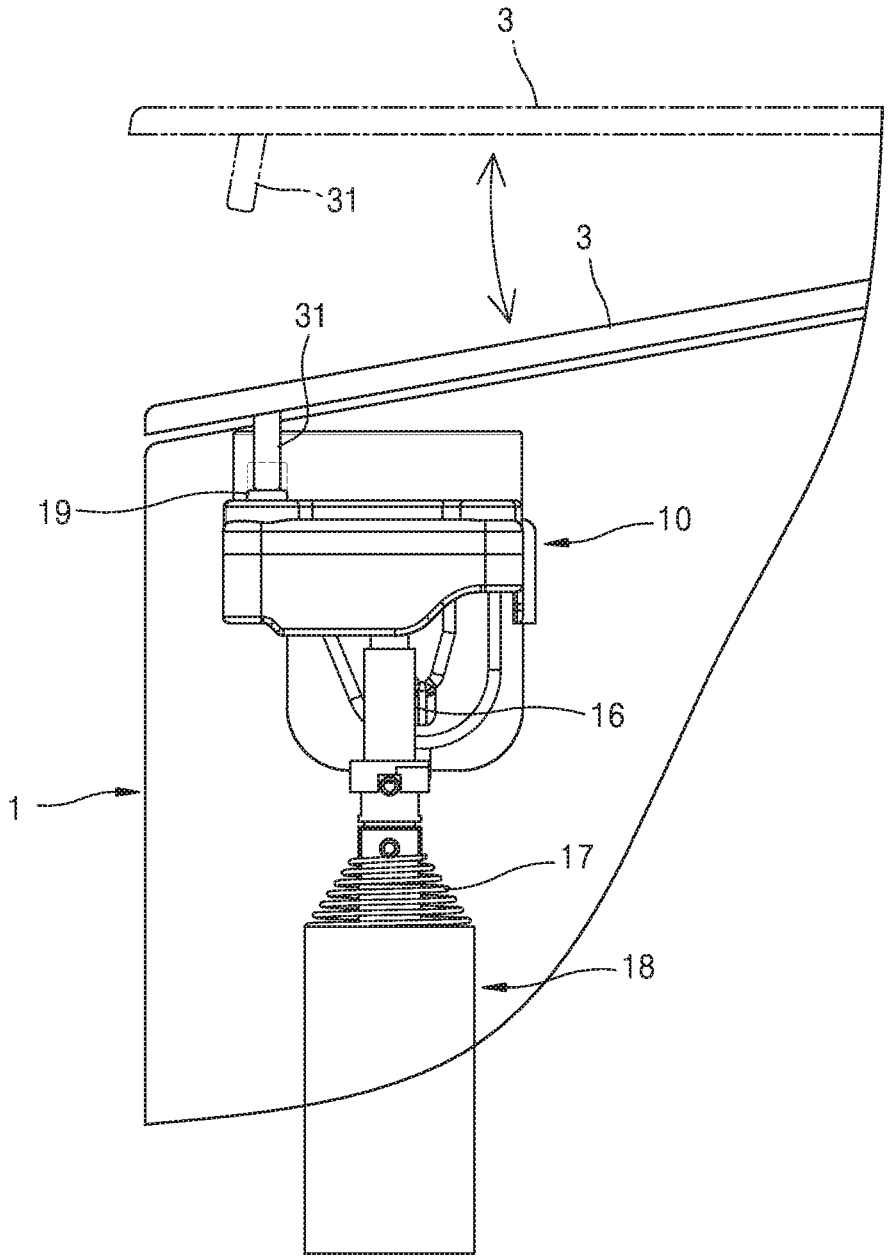
FIG. 17 is a partial perspective view of a structure of switching a second latch member to a fourth position, according to an example.

When the development cartridge 2 is mounted in the main body 1, the second latch member 19 is switched to the fourth position. Switching of the second latch member 19 to the fourth position may be performed in conjunction with a closing operation of the door 3. FIG. 17 is a partial perspective view of a structure of switching the second latch member 19 to the fourth position, according to an example. Referring to FIGS. 12, 13, and 17, the second latch member 19 protrudes upwardly from the upper body 13 through a through hole 136 formed in the upper body 13. The door 3 is provided in the main body 1 to open or close a portion of the main body 1 to attach/detach the development cartridge 2 to/from the main body 1. According to the present example, the door 3 partially opens an upper portion of the main body 1. A releasing member 31 that switches the second latch member 19 to the fourth position via a closing operation of the door 3 is provided in the door 3. For example, the releasing member 31 may be protruded from an inner surface of the door 3 and press the second latch member 19 in an opposite direction to the elastic force of the second latch spring 20 when the door 3 is closed, thereby switching the second latch member 19 to the fourth position. By opening the door 3, the releasing member 31 is spaced apart from the second latch member 19, and the second latch member 19 may return from the fourth position to the third position via the elastic force of the second latch spring 20 and be maintained in the third position.

According to this configuration, when the development cartridge 2 is separated from the main body 1, the inlet shutter 14 may be locked in the blocking position via the second latch member 19. As the development cartridge 2 is mounted in the main body 1, the releasing member 31 presses the second latch member 19 via a closing operation of the development cartridge 2, thereby switching the second latch member 19 to the fourth position. Accordingly, according to operation of the first latch member 16 and the switching unit 18, the inlet shutter 14 may be locked in the blocking position or the inlet position, and rotated from the blocking position to the inlet shutter 14 or in an opposite direction thereto.

While examples have been described with reference to the figures, it will be understood by those of ordinary skill in the art that various changes in form and details may be made therein without departing from the spirit and scope as defined by the following claims.

What is claimed is:

1. A printer comprising:

a main body including a communicating portion;

a development cartridge attachable to and detachable from the main body, the development cartridge to supply toner contained in a toner container to an electrostatic latent image formed on a photoconductor, to form a visible toner image;

a toner refilling portion connected to the toner container, the toner refilling portion comprising a mounting portion into which a toner cartridge is insertable from outside the main body through the communicating portion to be mounted to the mounting portion, a toner inlet portion provided in the mounting portion to receive toner from the toner cartridge when the toner cartridge is mounted to the mounting portion, and an inlet shutter that is switchable between a blocking position where the toner inlet portion is blocked from receiving toner, and an inlet position where the toner inlet portion is open to receive toner;

a first latch member switchable between a first position where the inlet shutter is locked from switching between the blocking position and the inlet position, and a second position where switching of the inlet shutter is allowed to switch between the blocking position and the inlet position; and a switching unit to switch the first latch member between the first position and the second position.

2. The printer of claim 1, wherein the toner refilling portion comprises a first latching portion provided in the inlet shutter, to catch the first latch member in the first position when the inlet shutter is in the blocking position.

3. The printer of claim 2, wherein the toner refilling portion comprises a second latching portion provided in the inlet shutter, to catch the first latch member in the first position when the inlet shutter is in the inlet position.

4. The printer of claim 1, wherein the toner refilling portion is integrated with the development cartridge to be attachable to and detachable from the main body together with the development cartridge.

5. The printer of claim 1, wherein the toner refilling portion includes the first latch member, and the main body includes the switching unit.

6. The printer of claim 5, comprising a first latch spring via which an elastic force is applied to the first latch member in a direction in which the first latch member returns to the second position.

7. The printer of claim 6, wherein the switching unit comprises:

a rotational cam including a cam track having a first cam portion corresponding to the first position of the first latch member, and a second cam portion corresponding to the second position of the first latch member;

a motor to rotate the rotational cam; and a movable member guided to the first cam portion and the second cam portion, to switch the first latch member to the first position and the second position.

8. The printer of claim 7, comprising a cam spring via which an elastic force is applied to the movable member in a direction in which the movable member contacts the cam track.

9. The printer of claim 7, comprising a phase detecting sensor to detect a rotational phase of the rotational cam.

10. The printer of claim 1, wherein the toner refilling portion is integrated with the development cartridge to be attachable to and detachable from the main body together with the development cartridge, and the first latch member and the switching unit are provided in the main body.

11. The printer of claim 10, wherein the switching unit comprises a solenoid comprising a solenoid body, a driving shaft to which the first latch member is connected, and a first latch spring via which an elastic force is applied to the driving shaft in a direction in which the first latch member enters the first position.

12. The printer of claim 10, comprising:

a third latching portion provided in the inlet shutter;

a second latch member having a third position where the second latch member is caught by the third latching portion when the inlet shutter is in the blocking position to lock the inlet shutter and a fourth position where the second latch member is released from the third latching portion;

a door to open and close a portion of the main body, to allow the development cartridge to be attachable to and detachable from the main body; and a releasing member provided in the door, the releasing member to switch the second latch member to the fourth position via a closing of the door.

13. The printer of claim 12, comprising a second latch spring via which an elastic force is applied to the second latch member in a direction in which the second latch member enters the third position.

14. A development cartridge for a printer, comprising:

a toner container;

a mounting portion to which a toner cartridge to refill toner in the toner container is mountable, the mounting portion being connected to the toner container;

a toner inlet portion provided in the mounting portion to receive toner from the toner cartridge when the toner cartridge is mounted to the mounting portion;

an inlet shutter that is switchable between a blocking position where the toner inlet portion is blocked from receiving toner, and an inlet position where the toner inlet portion is open to receive toner;

a first latch member switchable between a first position where the inlet shutter is locked from switching between the blocking position and the inlet position, and a second position where switching of the inlet shutter is allowed to switch between the blocking position and the inlet position;

a first latching portion provided in the inlet shutter, to catch the first latch member in the first position when the inlet shutter is in the blocking position; and a second latching portion provided in the inlet shutter, to catch the first latch member in the first position when the inlet shutter is in the inlet position, respectively.

15. The development cartridge of claim 14, comprising a first latch spring via which an elastic force is applied to the first latch member in a direction in which the first latch member enters the first position.

* * * * *